United States Patent [19]

Bächinger

[11] 4,372,499

[45] Feb. 8, 1983

[54] PROCESS AND APPARATUS FOR PREPARING FABRIC PATTERNS

[76] Inventor: Peter Bächinger, Bergli, 9630 Wattwil, Switzerland

[21] Appl. No.: 141,901

[22] Filed: Apr. 21, 1980

[30] Foreign Application Priority Data

Oct. 15, 1979 [CH] Switzerland ..... 9262/79

[51] Int. Cl.[3] ..... B65H 54/68

[52] U.S. Cl. ..... 242/50; 28/184; 28/299; 242/1

[58] Field of Search ..... 242/50, 47, 1, 18, 7.13, 242/18 A, 61; 28/184, 299

[56] References Cited

U.S. PATENT DOCUMENTS

| | | | |
|---|---|---|---|
| 1,448,980 | 3/1923 | Schmutz | 242/50 |
| 2,554,855 | 5/1951 | Creed | 242/50 |
| 2,589,503 | 3/1952 | McCullough | 242/50 X |
| 3,018,062 | 1/1962 | Rice, Jr. | 242/50 |
| 3,882,658 | 5/1975 | Cleary | 242/50 X |

*Primary Examiner*—Stanley N. Gilreath
*Attorney, Agent, or Firm*—Wegner, McCord, Wood & Dalton

[57] ABSTRACT

A fabric winding process and apparatus for preparing a fabric pattern. A winding machine comprises a rotary drive mechanism for intermittent rotation of two card-holding chucks, and a thread-guide carriage which is translatable along a path adjacent a card held by the chucks parallel to the axis of rotation of the card. The drive mechanism and carriage are coupled such that when the winding card is not rotating, the carriage shifts a distance corresponding to a selected number of turns on the winding card such that a yarn of a selected color is wound about the card at all points on the card corresponding to the color in the desired fabric pattern. In this way, a desired pattern may be prepared without the necessity of threading or knotting several yarns together.

11 Claims, 2 Drawing Figures

PROCESS AND APPARATUS FOR PREPARING FABRIC PATTERNS

BACKGROUND OF THE INVENTION

1. Field of the Invention

This invention is directed to a method and apparatus for preparing fabric patterns and, more particularly, this invention is directed to a method and apparatus for preparing fabric designs of multiple colors.

2. Description of the Prior Art

In prior fabric preparation methods, manual or automatic looms were used to produce relatively narrow strips of fabric. Such weaving methods were relatively expensive.

In an effort to reduce expense, it has been proposed that fabric patterns not be woven, but rather be prepared by winding yarns onto a winding card of cardboard or other durable material. Such wound fabric patterns have replaced, to some extent, prior woven and other fabric patterns.

In prior winding processes, yarns of various colors were wound seriatim onto a card by hand in a predetermined order, which order determined the desired pattern. After a first yarn of a selected color was so wound, a second colored yarn was knotted by hand to the first yarn on the rear side of the card, and wound about the card for a predetermined number of times. This procedure was repeated until the desired pattern was obtained.

Prior fabric pattern winding machines have had a motor driven card and a yarn-guide carriage coupled, through a spindle, to the card drive. In order to change yarns it was necessary to knot adjacent yarns by hand on the rear of the card. This procedure was cumbersome and time-consuming, and required a highly skilled operator.

SUMMARY OF THE INVENTION

This invention is directed to overcoming one or more of the problems described above.

According to the present invention, a multiple color fabric pattern is produced on an intermittently rotatable card by winding all turns of a selected color yarn at predetermined points on the card before second and subsequent yarns are wound on the card.

Each color yarn is wound about the card to form a selected number of windings spaced at selected intervals on the card. Each winding comprises a selected number of relatively closely spaced turns. The yarn extends between the last turn of one winding to the first turn of an adjacent winding across the spacing between the windings on the rear of the card. Upon completion of the windings of a particular color, windings of yarns of second and subsequent selected colors are made about the card at predetermined points thereon.

The method of the invention is carried out with an apparatus comprising a rotary drive mechanism releasably coupled to card holding means for intermittent rotation thereof, a translatable carriage having a guide rail or other guide means for maintaining a translatory path parallel to the axis of rotation of the card, and a transmission coupling the drive mechanism to the carriage.

To produce a series of windings, one end of a yarn is secured to the rear of the card, which is then rotated a predetermined number of turns as the carriage is translated a predetermined distance corresponding to the number of turns, and yarn is fed from the carriage to the card. A second winding spaced from the first is produced by holding the card stationary while the carriage is translated a predetermined distance, followed by rotation of the card for a predetermined number of turns during further translation of the carriage.

After the first color of yarn is wound about the card at all points corresponding to the first yarn color in the desired pattern, the process is repeated with second and subsequent yarns of selected colors to produce spaced windings of various colors at points corresponding to colored windings in the desired pattern.

Other objects and advantages will be apparent from the following detailed description, the drawings and the appended claims.

DETAILED DESCRIPTION OF THE INVENTION

Figure 1:
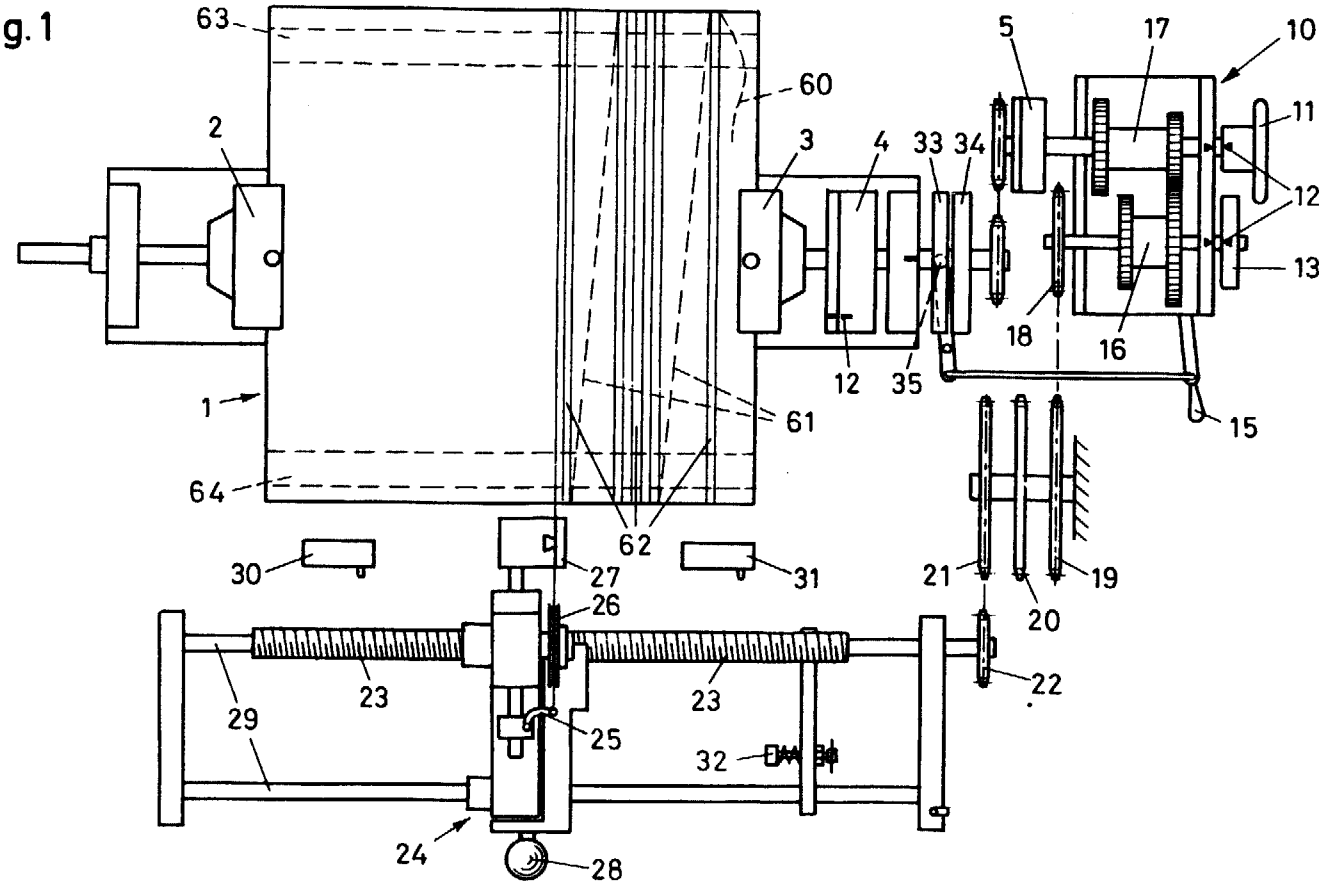
FIG. 1 is a schematic representation of an apparatus for carrying out the method of the present invention.

Referring to FIG. 1, a winding card 1, of a durable material such as cardboard, for example, is held by two axially opposed rotatable chucks 2 and 3. Chuck 2 is supported freely and the other chuck 3 is coupled through a clutch 4 and a coupling 5 to a rotary drive means, preferably comprising a gear box 10. Clutch 4 and coupling 5 are each controllable and are preferably electromagnetically controllable.

The gear box 10 includes a handwheel 11 and a pulse counter 13, each having a reference mark 12. Gear box 10, which is drivable by the handwheel 11 or other suitable rotary drive means (not shown), further includes two pairs 16 and 17 of drive gears, the gears of each pair 16, 17 being rotatable with respect to the gears of the other pair, and fixed relative to each other. Gear pair 16 is switchable by means of lever 15, which also switches one gear 18 of a transmission which comprises gears 18–22. Gear 22 is fixed to a rotatable threaded spindle 23 which carries a thread-guide carriage 24 for translation thereon.

The carriage 24 comprises a thread guide 25, a thread brake 26 and a thread-guide plate 27. A revolving gate (not shown) holds yarn spools in alignment with the thread guide 27. Such gates are well known in the art. A lever 28 releasably couples the carriage 24 to the spindle 23. A guide rod 29 maintains a guide path for the carriage 24, preferably parallel to the axis of rotation of the chucks 2 and 3. Two limit switches 30 and 31 are disposed at predetermined end points of the winding pattern desired to be prepared on the card 1. An abutment stop 32 is disposed on the guide rod 20 at a point corresponding to one edge of the winding card 1.

A pair of pulse generators 33, 34 are coupled to the clutch 4 and are selectively engaged by a magnetic selector 35 operatively connected to the shift lever 15.

The winding card 1 must be flat, with cleanly-cut edges. Preferably, one side should be black and the other side white. The thread brake 26 is adjusted to provide a thread tension of 80–100 g on the thread behind the thread-guide plate 27. If the thread's tension is too small, threads are easily displaced. If the tension is too high, then the winding card may become distorted.

In order to wind the card accurately, the distance between the guide plate 27 and the edge of the card should be of the order of 5 mm.

Figure 2:
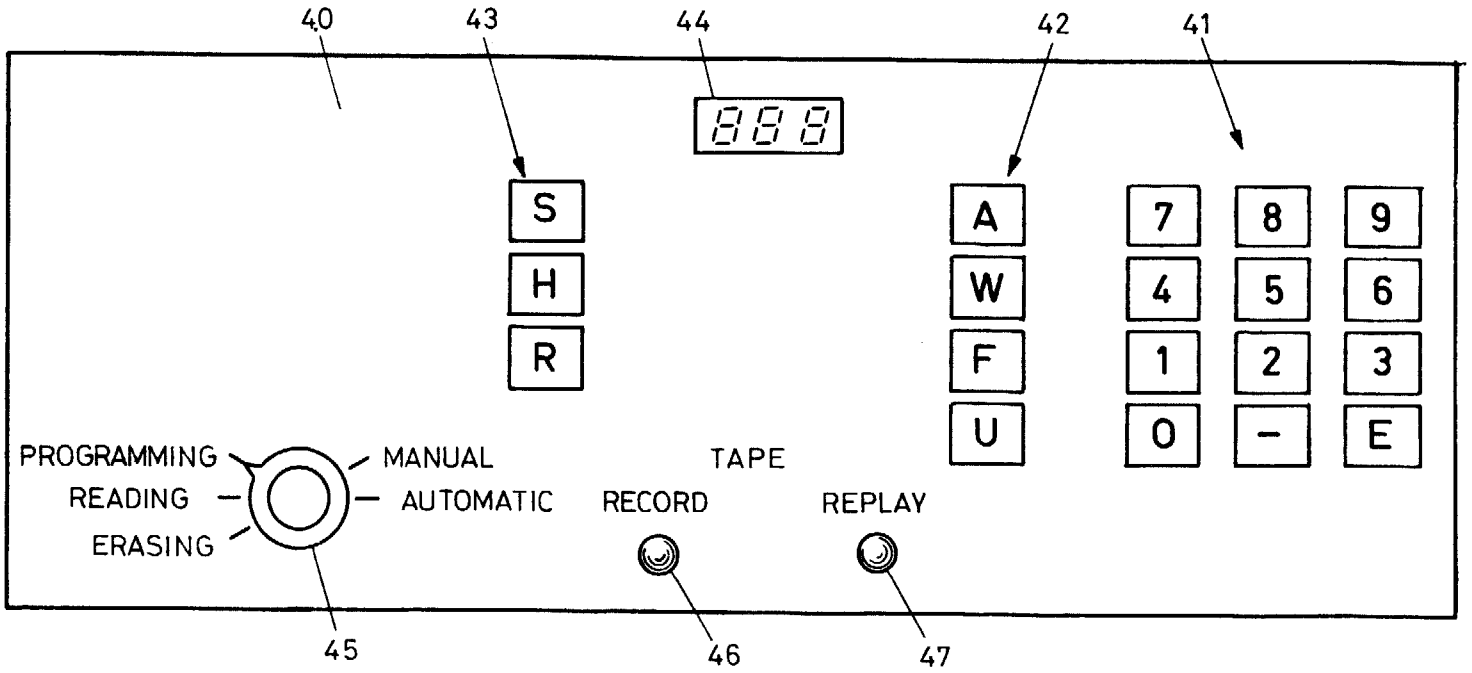
FIG. 2 is a schematic of control data input means for controlling the operation of the apparatus of FIG. 1.

FIG. 2 shows a control panel 40 for a control instrument (not shown) which can be constructed by any person skilled in the electronics and/or data processing arts. The instrument has a working memory which can store entered data and from which such data can be repeatedly retrieved. The control instrument also has a permanent memory for storage and retrieval of data stored in the working memory.

The permanent memory preferably comprises a magnetic tape recorder, such as a cassette recorder, for example. A preferred recorder is the Grundig Type C450 Automatic.

The control panel 40 has a first keyboard 41 with twelve keys 0–9, —and E, a second keyboard 42 with four keys A, W, F, U, a third keyboard 43 with keys S, H, R and a display field 44 with three 7-segment displays, such as LED displays, for example. Key H is an interrupt key and is not required for normal operation of the apparatus. Two indicator lamps 46 and 47 labeled "Record" and "Replay", respectively, indicate the operating mode of the permanent memory. A switch 45 selects the instrument's respective operating modes, including programming, reading and erasing the memory, and manual or automatic operation.

Assuming that the permanent memory comprises a magnetic tape recorder, the mode of operation is as follows:

Key F of keyboard 42 indicates that a subsequently entered single digit selected from keyboard 41 corresponds to the yarn color desired to be wound. Key U of keyboard 42 indicates that the subsequently entered two-digit number (also selected from keyboard 41) corresponds to the desired number of card revolutions. An example of a program is as follows:

F1 U27, F4 U13, F2 U26 . . .

The entered numbers appear in the display field 44 as they are entered.

The working memory is activated and all previous inputs erased by depression of key R of keyboard 43 at the beginning of the program. The first input, e.g. "F01" is then entered on keyboards 41 and 42. The second input, e.g. "U27", is entered in the same way, and the numbers "127" are simultaneously displayed in the field 44. Key E (keyboard 41) is then depressed to enter these data into the working memory. The memory then automatically switches to the next memory location for entry therein of subsequent data, e.g. "413" and "226".

Key "S" (keyboard 43) is depressed to instruct the working memory to repeatedly enter previously stored data. Thus, when key S is depressed and a number, for example, 2, is entered, the stored data is repeated the specified number of times and added to the existing data in the working memory. According to the foregoing, the following is stored in the working memory: 127, 413, 226, 127, 413, 226, 127, 413, 226. This procedure can be expanded as desired.

When the working memory contains data corresponding to the maximum possible number of turns on the card, the data stored in the working memory are transferred to the permanent memory (e.g. a magnetic tape) as by a modulation process or any other transfer or re-recording process known in the art. This process is controlled as follows, for example:

The mode selector switch 45 is set to "Program", and key R (keyboard 43) is depressed to activate the beginning of the program. The permanent memory is switched to "Record" as by depressing key for "Record" and key for "Start" as known from recorders, at the same time. When key A is depressed, data in the working memory are transferred to the permanent memory.

Similarly, a program from the permanent memory may be transferred to the working memory by deactivating the permanent memory and depressing key W ("Replay"). The transfer between the "Record" and "Replay" modes is monitored by control lamps 46 and 47.

When a card is to be wound according to the stored program, the rate of card rotation and hence the winding density is selected with lever 15, which simultaneously selects a pulse generator 33 or 34 by shifting the magnetic selector 35. For example, pulse generator 33 is activated if the winding density is selected as shown in FIG. 1.

In the position shown in FIG. 1, gears 18 and 19 are engaged and the drive from handwheel 11 is transmitted to gears 21 and 22, resulting in a relatively rapid rate of translation of the carriage 24.

Shifting of the lever 15 to the left in FIG. 1 causes gear 18 to engage gear 20. Gear 20 is an auxiliary gear to engage gear 18 when it is shifted along with gear 16 during a change of gear ratio in the gear box 10. The left-hand gears of pairs 16, 17 are engaged with each other so that the rate of translation of the thread-guide carriage 24 is decreased, for example, twofold.

Two two-sided adhesive tapes 63, 64 are applied along the upper and lower edges of the rear side of the winding card 1. One end 60 of a yarn of a selected color is secured to tape 63.

The selector switch 45 is turned to "Auto" (automatic) and key R is depressed to reverse the drive on the gear box 10 to shift the carriage 24 to the right in FIG. 1 until it contacts limit switch 31. The program is started by depressing key F and the number corresponding to the first selected color, and the apparatus is started by depressing key S.

Preparation of a plurality of windings 62 each having a preselected number of tightly spaced turns is carried out with the first yarn. The number of windings is counted by the selected pulse generator 33 or 34, and selector 35. The winding card 1 is then stopped by automatic actuation of the coupling 5 and brake 4, and the thread-guide carriage is automatically shifted to the left a distance corresponding to a selected number of windings, as programmed, which are counted with pulse counter 13. Thus, the yarn turn 61 extending between final and initial turns of adjacent windings 62 on the rear of the card is obtained.

Reference markings 12 on the pulse counter 13, handwheel 11 and brake 4 allow ready adjustment of the winding card 1, so that brake 4 is actuated only when the rear of winding card 1 faces the yarn. The markings 12 on handwheel 11 allow adjustment of the gears 16, 17 for activation and deactivation of the apparatus. Similarly, marking 12 on pulse counter 13 allows the number of card revolutions to be readily determined during manual operation.

The foregoing winding process is continued with the first yarn until all points on the card corresponding to the first selected color are wound with the first yarn. The program is then repeated with the second selected yarn. Thus, it is apparent that the yarns need not be knotted together after preparation of each winding 62. The yarns may be single or double-threaded, as was possible in prior hand winding techniques.

The foregoing description is given for clearness of understanding only, and no unnecessary limitations should be inferred therefrom, as modifications will be obvious to those skilled in the art.

I claim:

1. In a process of preparing a fabric pattern by winding a plurality of yarns of various colors in a pattern about a rectangular card having front and rear sides, said pattern having at least one repetitive color with at least one different color interposed between repetitions, the improvement comprising the consecutive steps of winding a first yarn of a first selected color about said card at all points corresponding to said first color in said fabric pattern before a yarn of another color is wound about said card, and winding a second yarn of a second selected color about said card at all points corresponding to said second color in said fabric pattern.

2. The improvement of claim 1 including the step of winding each of said yarns about said card in a plurality of windings spaced on said card wherein each said winding is formed by winding said yarn into a plurality of turns being spaced relatively closely in comparison to the spacings between said windings.

3. The improvement of claim 2 wherein said windings are spaced from one another by extending said yarn from the last turn of a first winding to a point on said card spaced from said last turn a distance substantially greater than the spacing between said turns and winding the turns of an adjacent winding.

4. The improvement of claim 2 wherein said yarn comprises a single thread.

5. The improvement of claim 2 wherein said yarn is double-threaded.

6. An apparatus for preparing a fabric pattern, comprising: rotary drive means, means for holding a rectangular card, means releasably coupling said card holding means to said drive means for controlled intermittent rotation of said card, a translatable thread-carrying carriage, means for guiding said carriage in a path parallel to the axis of rotation of said card, means for accurately guiding thread from said carriage to said card, means coupled to said drive means for controlling the speed of rotation thereof, and means selectively coupling said drive means to said carriage for transmittal of driving force to said carriage to effect translation of said carriage.

7. The apparatus of claim 6 wherein said means coupling said drive means to said card holding means includes a transmission for selective control of the rate of card rotation.

8. The apparatus of claim 7 wherein said drive means is driven continuously and said means coupling said card holding means to said drive means includes a clutch for selective disconnection of said drive means from said card holding means.

9. The apparatus of claim 6 wherein said control means includes a working memory and means for inputting data to said working memory, said data defining a desired number of card revolutions and the color of a yarn to be wound during said revolutions.

10. The apparatus of claim 9 wherein said input means comprises a keyboard coupled to said working memory, said control means further including a permanent memory and the working memory further including a data-transfer channel coupling said working and permanent memories, whereby said data may be transferred to said permanent memory from said working memory for storage and retrieval of said data in and from said permanent memory.

11. The apparatus of claim 10 wherein said permanent memory comprises a magnetic tape recorder.

* * * * *